US006508207B2

(12) United States Patent
Shellenberger et al.

(10) Patent No.: US 6,508,207 B2
(45) Date of Patent: Jan. 21, 2003

(54) FLAMMABLE VAPOR RESISTANT WATER HEATER WITH LOW $NO_X$ EMISSIONS

(75) Inventors: Timothy J. Shellenberger, Johnson City, TN (US); Thomas A. Edds, Jonesborough, TN (US); Aleksandr V. Kovalenko, Johnson City, TN (US); Kelsey S. Dorrough, Johnson City, TN (US); Jeff L. Lyons, Gray, TN (US)

(73) Assignee: SRP 687 Pty. Ltd. (AU)

( * ) Notice: Subject to any disclaimer, the term of this patent is extended or adjusted under 35 U.S.C. 154(b) by 0 days.

(21) Appl. No.: 09/728,986

(22) Filed: Feb. 7, 2001

(65) Prior Publication Data

US 2002/0066420 A1 Jun. 6, 2002

(51) Int. Cl.[7] ..... F23D 14/62; F22B 5/04
(52) U.S. Cl. ..... 122/14.31; 431/354
(58) Field of Search ..... 122/13.01, 14.31, 122/14.1; 126/307 A, 39 E; 431/266, 354

(56) References Cited

U.S. PATENT DOCUMENTS 5,341,767 A * 8/1994 Smith ..... 122/14
6,109,216 A * 8/2000 Reynolds et al. ..... 122/14.1
6,190,163 B1 * 2/2001 Maricic et al. ..... 431/354

* cited by examiner

*Primary Examiner*—Gregory Wilson
(74) *Attorney, Agent, or Firm*—Schnader Harrison Segal & Lewis LLP

(57) ABSTRACT

A water heater including a water container; a combustion chamber adjacent the container, the combustion chamber having at least one air inlet to admit air and extraneous fumes into the combustion chamber and confine ignition and combustion of the extraneous fumes within the combustion chamber; a burner associated with the combustion chamber and arranged to combust fuel to heat water in the container; and an air diverter positioned between the air inlet and the burner and adapted to channel at least a portion of combustion air passing through at least a portion of the air inlet to a position for mixture with the fuel prior to entering the burner to slow combustion and thereby reduce combustion temperatures and $NO_x$ emissions.

15 Claims, 8 Drawing Sheets

FLAMMABLE VAPOR RESISTANT WATER HEATER WITH LOW $NO_X$ EMISSIONS

FIELD OF INVENTION

This invention relates to water heaters, particularly to improvements to gas fired water heaters adapted to render them safer for use and to reduce $NO_x$ emissions.

BACKGROUND OF INVENTION

The most commonly used gas-fired water heater is the storage type, generally comprising an assembly of a water tank, a main burner to provide heat to the tank, a pilot burner to initiate the main burner on demand, an air inlet adjacent the burner near the base of the jacket, an exhaust flue and a jacket to cover these components. Another type of gas-fired water heater is the instantaneous type which has a water flow path through a heat exchanger heated, again, by a main burner initiated from a pilot burner flame.

For convenience, the following description is in terms of storage type water heaters but the invention is not limited to this type. Thus, reference to "water container," "water containment and flow means," "means for storing or containing water" and similar such terms includes water tanks, reservoirs, bladders, bags and the like in gas-fired water heaters of the storage type and water flow paths such as pipes, tubes, conduits, heat exchangers and the like in gas-fired water heaters of the instantaneous type.

A particular difficulty with many locations for water heaters is that the locations are also used for storage of other equipment such as lawn mowers, trimmers, snow blowers and the like. It is a common procedure for such machinery to be refueled in such locations.

There have been a number of reported instances of spilled gasoline and associated extraneous fumes being accidently ignited. There are many available ignition sources, such as refrigerators, running engines, electric motors, electric and gas dryers, electric light switches and the like. However, gas water heaters have sometimes been suspected because they often have a pilot flame.

Vapors from spilled or escaping flammable liquid or gaseous substances in a space in which an ignition source is present provides for ignition potential. "Extraneous fumes," "fumes" or "extraneous gases" are sometimes hereinafter used to encompass gases, vapors or fumes generated by a wide variety of liquid volatile or semi-volatile substances such as gasoline, kerosene, turpentine, alcohols, insect repellent, weed killer, solvents and the like as well as non-liquid substances such as propane, methane, butane and the like.

Many inter-related factors influence whether a particular fuel spillage leads to ignition. These factors include, among other things, the quantity, nature and physical properties of the particular type of spilled fuel. Also influential is whether air currents in the room, either natural or artificially created, are sufficient to accelerate the spread of fumes, both laterally and in height, from the spillage point to an ignition point yet not so strong as to ventilate such fumes harmlessly, that is, such that air to fuel ratio ranges are capable of enabling ignition are not reached given all the surrounding circumstances.

One surrounding circumstance is the relative density of the fumes. When a spilled liquid fuel spreads on a floor, normal evaporation occurs and fumes from the liquid form a mixture with the surrounding air that may, at some time and at some locations, be within the range that will ignite. For example, the range for common gasoline vapor is between about 2% and 8% gasoline with air, for butane between 1% and 10%. Such mixtures form and spread by a combination of processes including natural diffusion, forced convection due to air current drafts and by gravitationally affected upward displacement of molecules of one less dense gas or vapor by those of another more dense. Most common fuels stored in households are, as used, either gases with densities relatively close to that of air (e.g. propane and butane) or liquids which form fumes having a density close to that of air, (e.g. gasoline, which may contain butane and pentane among other components is very typical of such a liquid fuel).

In reconstructions of accidental ignition situations, and when gas water heaters are sometimes suspected and which involved spilled fuels typically used around households, it is reported that the spillage is sometimes at floor level and, it is reasoned, that it spreads outwardly from the spill at first close to floor level. Without appreciable forced mixing, the air/fuel mixture would tend to be at its most flammable levels close to floor level for a longer period before it would slowly diffuse towards the ceiling of the room space. The principal reason for this observation is that the density of fumes typically involved is not greatly dissimilar to that of air. Combined with the tendency of ignitable concentrations of the fumes being at or near floor level is the fact that many gas appliances often have their source of ignition at or near that level.

Earlier efforts, such as those disclosed in U.S. Pat. No. 5,797,355, substantially raised the probability of successful confinement of ignition of spilled flammable substances from typical spillage situations to the inside of the combustion chamber. Other following structures, such as those disclosed in U.S. Pat. Nos. 5,950,573; 6,003,477; 6,082,310; 6,085,699; and 6,085,700, for example, have built on the break through success of '355.

Although the water heaters described in the above-identified patents have been well received and highly successful with respect to increasing the resistance to ambient flammable vapors, certain portions of the U.S., especially California have stringent low $NO_x$ emissions regulations and requirements. We have discovered an ongoing challenge associated with meeting these limits with such structures for the following reasons.

An important element of such flammable vapor resistant water heaters is a flame arrestor or flame trap placed strategically in the air intake opening to the combustion chamber of the water heater. This is accomplished by creating a controlled opening for combustion air and otherwise sealing off the combustion chamber. It was discovered that placement of the flame arrestor relative to the pilot is important in consistently igniting the flammable vapors in different spill scenarios. Both the pilot and main burners must be able to light the flammable vapors soon after they enter the combustion chamber.

There are also preexisting conditions that dictate the relative positioning of the pilot to the burner that it is to ignite. Thus, the design wherein the same pilot that would light the burner would also ignite the flammable vapors, if present, had the effect of setting a relationship of the inlet air relative to the burner. The result was that the air inset for the flame trap is off center and not symmetrical.

Most natural gas burners used in storage water heaters are "pan" burners. They are made of sheet metal making them a very economical choice and their flame pattern is well suited for heating a typical storage tank bottom. Such pan burners are designed to operate with air evenly distributed around the inlet to the mixing chamber of the burner. They have the opening to the mixing chamber placed at a specific distance and concentricity from a gas orifice. This allows the gas to flow from the orifice and mix with the combustion air consistently and unencumbered.

However, in that design, the relationship of the flame arrestor to pilot to burner creates imbalances in the availability and locations of primary and secondary air through out the combustion chamber. This imbalance can cause several side effects in the combustion process. It leads to higher levels of $NO_x$ production as the flame temperature runs hotter on the non-arrestor side due to lack of excess air to help cool the process. The air at the mixing chamber opening is also distributed unevenly. This also contributes to higher $NO_x$ production by disturbing the ratio of primary and secondary air. This can deprive the burner of enough air to mix with the amount of fuel. The fuel and air may also not mix as intended. With the air availability skewed from side to side, the mixture may not be as homogenous as a mixing chamber in a symmetrical environment and, therefore, produce pockets of rich mixture and pockets that are too lean. This has been found to increase $NO_x$ production due to having isolated hot spots. It is known that one of the primary factors of $NO_x$ production is flame temperature exceeding 2800 degrees F. Formation of thermal $NO_x$ increases exponentially with combustion temperature, and increases by a square root relationship with the presence of oxygen in the combustion zone. This excessively rich primary mixture is also more likely to flashback on extinction when using alternate higher BTU input fuels that are required for ANSI testing. (Butane-Air). Accordingly, it has been a primary objective to produce a water heater that simultaneously addresses the issue of resistance to flammable vapors and can meet ever increasingly stringent low $NO_x$ emissions regulations and requirements by the various regulatory bodies.

SUMMARY OF THE INVENTION

The invention relates to a water heater including a water container and a combustion chamber adjacent the container. The combustion chamber has at least one flame trap to admit air and extraneous fumes into the combustion chamber. The flame trap (sometimes also referred to as an "air inlet" or "air inlet plate") has a plurality of ports. The ports are sized and shaped to cause air and extraneous fumes to pass through the ports, yet confine ignition and combustion of the extraneous fume species within the combustion chamber. The water heater includes a burner associated with the combustion chamber and arranged to combust fuel to heat water in the container. A low $NO_x$ draft hood is positioned relative to the burner and the flame trap to enhance combustion dynamics to reduce production of $NO_x$ emissions.

DETAILED DESCRIPTION OF THE INVENTION

Figure 1:
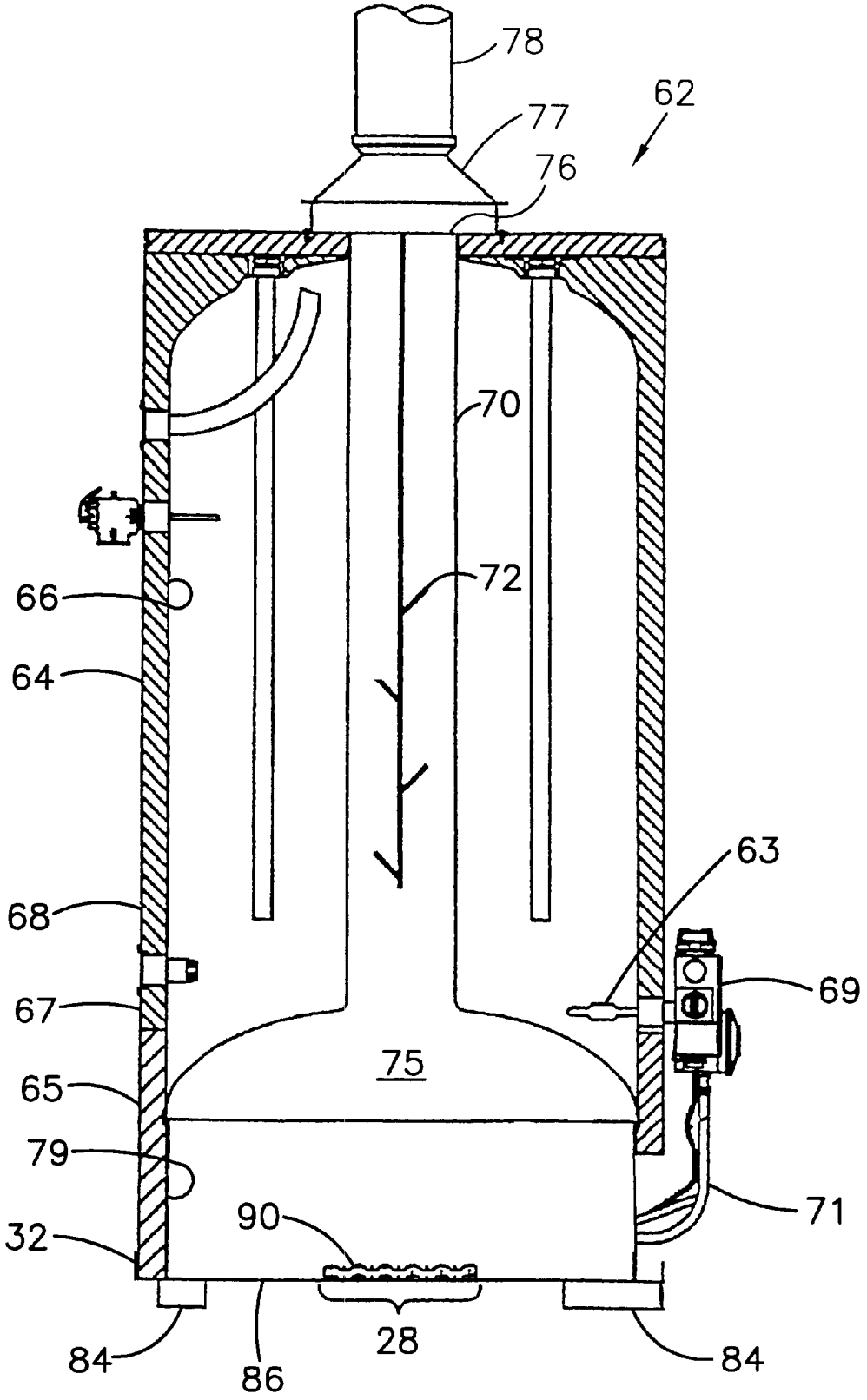
FIG. 1 is a schematic partial cross-sectional view of a gas-fueled water heater having an air inlet and low $NO_x$ hood according to the invention.

It will be appreciated that the following description is intended to refer to the specific embodiments of the invention selected for illustration in the drawings and is not intended to limit or define the invention, other than in the appended claims.

Turning now to the drawings in general and FIGS. 1–4 in particular, there is illustrated a storage type gas water heater 62 including jacket 64 which surrounds a water tank 66 and a main burner 74 in an enclosed chamber 75 that addresses and solves the longstanding problems described above. Water tank 66 is preferably capable of holding heated water at mains pressure and is insulated preferably by foam insulation 68. Alternative insulation may include fiberglass or other types of fibrous insulation and the like. Fiberglass insulation surrounds chamber 75 at the lowermost portion of water tank 66. It is possible that heat resistant foam insulation can be used if desired. A foam dam separates foam insulation 68 and the fiberglass insulation.

Located underneath water tank 66 is a pilot burner 73 and main burner 74 which preferably use natural gas as fuel or other gases such as LPG, for example. Other suitable fuels may be substituted. Main burner 74 receives combustion air through air inlet plate 90 and low $NO_x$ draft diverter 91 and then combusts gas admixed with air and the hot products of combustion rise up through flue 70, possibly with heated air. Water tank 66 is lined with a glass coating to provide corrosion resistance against the hot water content. It is also coated on part of the exterior surface with a glass coating to provide corrosion resistance to that portion particularly that forms the upper wall of the combustion chamber 75 and contacts the hot and corrosive products of combustion. The external glass coating is applied to about half the thickness of that of the internal lining since this results in a protective coating more resistant to cracking under the influence of sudden changes in temperature. Such cracking if it happens causes the coating to resemble a fish scale appearance and such scales could detach eventually and possibly partly block the air inlet plate 90. However, without this external protective coating, the steel surface of the tank 66 and lower portion of the flue 70 may shed flake-like rust products, which could risk blocking the air inlet plate 90.

Fuel gas is supplied to both burners 73, 74 through a gas valve 69 and a fuel line 71. Flue 70 in this instance, contains a series of baffles 72 to better transfer heat generated by main burner 74 to water within tank 66. Near pilot burner 73 is a flame detecting thermocouple (not shown) which is a known safety measure to ensure that in the absence of a flame at pilot burner 73 the gas control valve 69 shuts off the gas supply. The water temperature sensor 63, preferably located inside the tank 66, co-operates also with the gas control valve 69 to supply gas to the main burner 74 on demand.

The products of combustion pass upwardly and out the top of jacket 64 via flue outlet 76 after heat has been transferred from the products of combustion. Flue outlet 76 discharges conventionally into a draught diverter 77 which in turn connects to an exhaust duct leading outdoors.

Water heater 62 is mounted preferably on legs 84 to raise the base 86 of the combustion chamber 75 off the floor. In base 86 is an aperture 28 which is closed gas tightly by an air inlet plate 90 which admits all air for combustion of the fuel gas combusted through the main burner 74 and pilot burner 73, regardless of the relative proportions of primary and secondary combustion air used by each burner. Air inlet plate 90 is preferably made from a thin metallic perforated sheet of stainless steel.

Where base 86 meets the vertical combustion chamber walls 79, adjoining surfaces are thoroughly sealed by a circumferential seam 81 to prevent ingress of air or flammable extraneous fumes. Instead, the base 86 and walls 79 may be one piece. The underside of the base 86 is recessed inwardly from the lower end of the seam to create an air space 82 between it and a flat-bottomed support pan 56 illustrated in FIG. 8. This support pan 56 is used with the present invention also but is omitted from FIGS. 1–4 for clarity of illustration. The support pan 56 is provided with at least one hole 83 vertically below the air inlet plate in the base 86 to admit air into the air space 82.

Pilot flame establishment can be achieved by a piezoelectric igniter. A pilot flame observation window 93 can be provided which is sealed. Cold water is introduced at a low level of the tank 66 and withdrawn from a high level in any manner as already well known.

Referring to FIGS. 4–7, specifics of a burner 74 and air diverter 91\ are shown. Burner 74 is constructed of an upper sheet metal plate 100 and a lower sheet metal plate 102 that are fixed together in a known manner such as by spot welding or the like at a multiplicity of nodes 104. The diameter of upper sheet 100 is smaller than the diameter of lower sheet 102. The nodes are elongated in a radially-extending direction and form a series of elongated radially-extending channels 106 through which a mixture of fuel and combustion air pass prior to combustion of the fuel. An opening 108 is located at the outer terminus of substantially all of channels 106.

Upper sheet 100 is substantially "bowl-shaped", as is lower sheet 102, except that lower sheet 102 has an opening 110 centrally located which is formed by a downwardly-extending lip 112.

Diverter 91 includes a pair of substantially vertically oriented side walls 114 and an end wall 116 connected therebetween. The side walls 114 and end wall 116 are also connected together by a cover 118 as well as a lower floor 120. The side walls 114 taper towards each other in the direction which terminates in end wall 116. Floor 120 is sized such that it leaves a substantial opening 122 in a lowermost portion of air diverter 91. There is also an opening 124 formed by a lip 126 that is connected directly to lip 112 of burner 74. Lower floor 120 also has an opening 128 that is sized to receive fuel line 71. Fuel line 71 is terminated at opening 128 with a fuel injecting nozzle 129. Cover 118 has a curved portion 130 that is especially designed to cause an even flow of air into diverter 91 as air passes through opening 122 and towards opening 124. Curved portion 130 also causes the air flow to be such to maximize mixing with fuel prior to passage through opening 110 of burner 74 and through channels 106 of burner 74 prior to combustion.

During normal operation, water heater 62 operates in substantially the same fashion as conventional water heaters except that all air for combustion enters through air inlet plate 90. A portion of the air entering through air inlet plate 90 passes into air diverter 91 through opening 122, assisted by aspiration from a pressure drop in fuel flow through nozzle 129 as the fuel's velocity is increased by passing through the small opening in it. The fuel and air mix prior to passing through opening 110 and channels 106.

The invention, including the use of diverter 91, corrects the imbalance described above. We found that the diverter 91 increases the amount of primary air available by about 25%. This lowers the $NO_x$ levels below the industry-accepted value of 40 Ng/J or 55 ppm corrected to 3% oxygen. This structure also completely neutralizes tendencies of the burner to flashback to the orifice on flame extinction. Although we do not wish to be bound by any particular theory, we believe that air diverter 91 increases the velocity of the air mixing may contribute to this factor being so effectively answered. Because of the robustness of this design, concerning this flashback solution, we can also lower costs by using inexpensive burners with relatively low port loading that would normally flashback in this environment. Low port loads in natural gas burners are known to produce less $NO_x$.

This mode of combustion is brought about so that $NO_x$ emissions are reduced due to the proportioning and premixing of the air and fuel in proper ratios and so that combustion takes place in a slower and substantially even manner. Moreover, the multiplicity of holes 108 supply further even quantities of air calculated to lower flame temperatures, thereby reducing $NO_x$ emissions still further. This configuration inhibits soot formation or "candling" at nozzle 129. The remainder of the air in the combustion chamber can flow freely around the outer edge of the lower sheet 102 to contribute further secondary air to the main burner.

It is important that the lower edge of diverter 91, where opening 122 is located, does not physically contact air inlet plate 90. This could reduce the ability of air inlet plate 90 to confine potential ignition within the combustion chamber. It is accordingly preferred that a space or gap of at least about ¼-inch is maintained. Also, it is important that the curved portion 130 of cover 118 not extend across both elongated side edges of air inlet plate 90 inasmuch as this will potentially disturb the even flow of air currents around and through air inlet plate 90.

Also, it is preferable that opening 122 be aligned over the center of the perforated area of the air inlet plate 90 because the velocity profile of the air entering the combustion chamber is greatest above the center of plate 90. By taking air into the opening 122 of cover 118 at the highest available upward velocity a higher aeration is achieved in the primary stage of combustion, believed to amount to about 2 to 20% additional primary aeration. The higher upwardly then horizontally directed flow of incoming fresh air across the vertically emerging stream of gas or fuel from nozzle 129 is believed also to be a reason for the inhibiting of candling as mentioned above.

Figure 3:
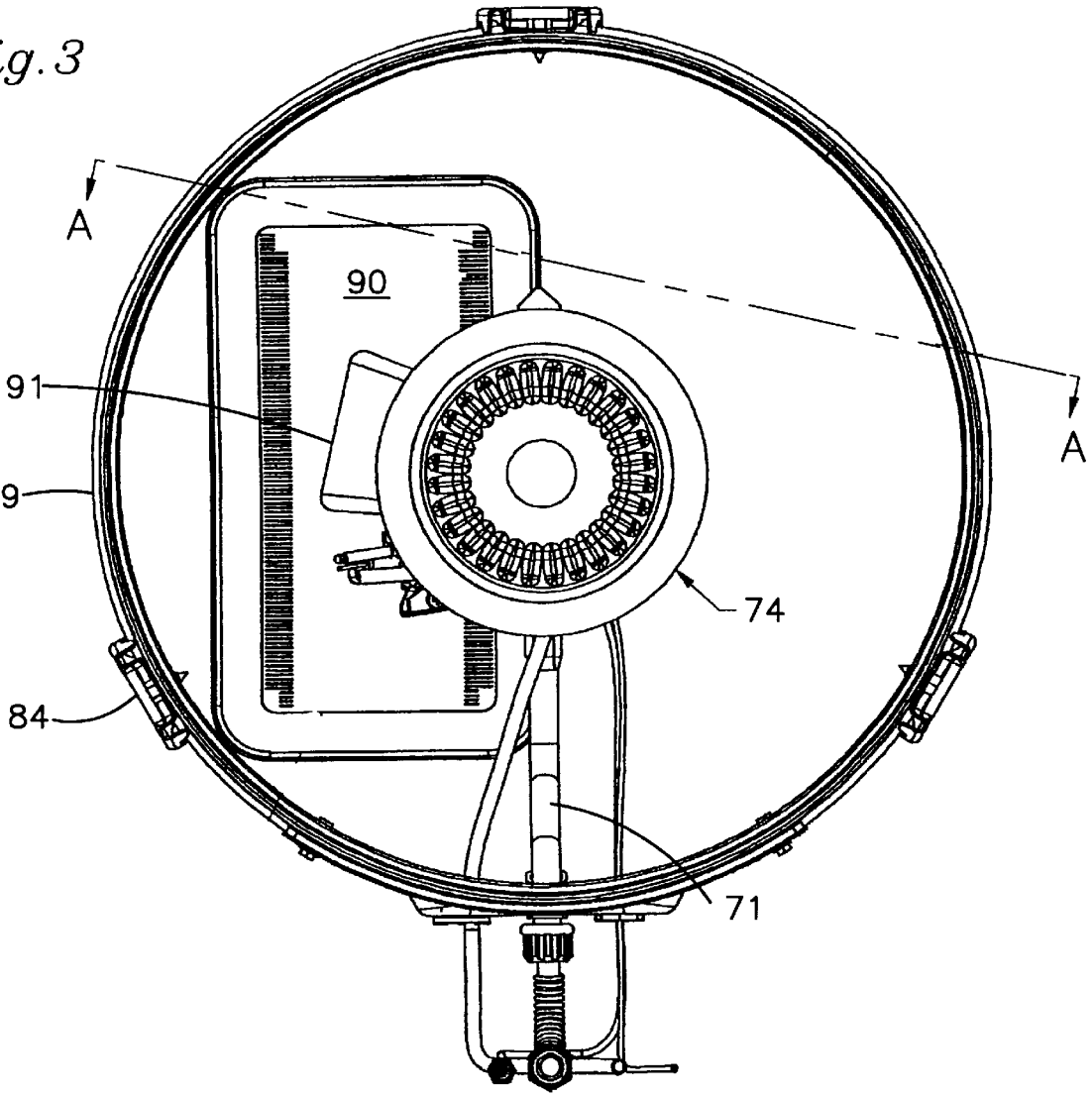
FIG. 3 is a top plan view of the combustion chamber shown in FIG. 2.

As best illustrated in FIG. 3, both air diverter 91 and pilot burner 73 are located side by side generally as close to the center of the perforated area of the air inlet plate 90 where the velocity of incoming air is highest. When flammable extraneous fumes enter the combustion chamber 75 the alignment of the pilot burner 73 generally over the center of the plate 90 (or near the center) has been found to minimize instances of high velocity or explosive initial ignition of fumes in the chamber.

If spilled fuel or other flammable fluid is in the vicinity of water heater 62 then some extraneous fumes from the spilled substance may be drawn through plate 90 by virtue of the natural draft characteristic of such water heaters. Air inlet 90 allows the combustible extraneous fumes and air to enter but confines potential ignition and combustion inside the combustion chamber 75.

The spilled substance taken into water heater 62 is burned within combustion chamber 75 and exhausted through flue 70 via outlet 76 and duct 78. Because flame is confined by the air inlet plate 90 within the combustion chamber, flammable substance external to water heater 62 will not be ignited.

With reference to FIG. 1, the size of air inlet plate 90 is dependent upon the air consumption requirement for proper combustion to meet mandated specifications to ensure low pollution burning of the gas fuel. Merely by way of general indication, the air inlet plate should be conveniently about 3700 $mm^2$ perforated area when fitted to a water heater having between 35,000 and 50,000 Btu/hr (approximate) energy consumption rating to meet ANSI requirements for overload combustion. Air diverter 91 is sized accordingly and preferably made from the same or similar material as air inlet plate 90.

Figure 2:
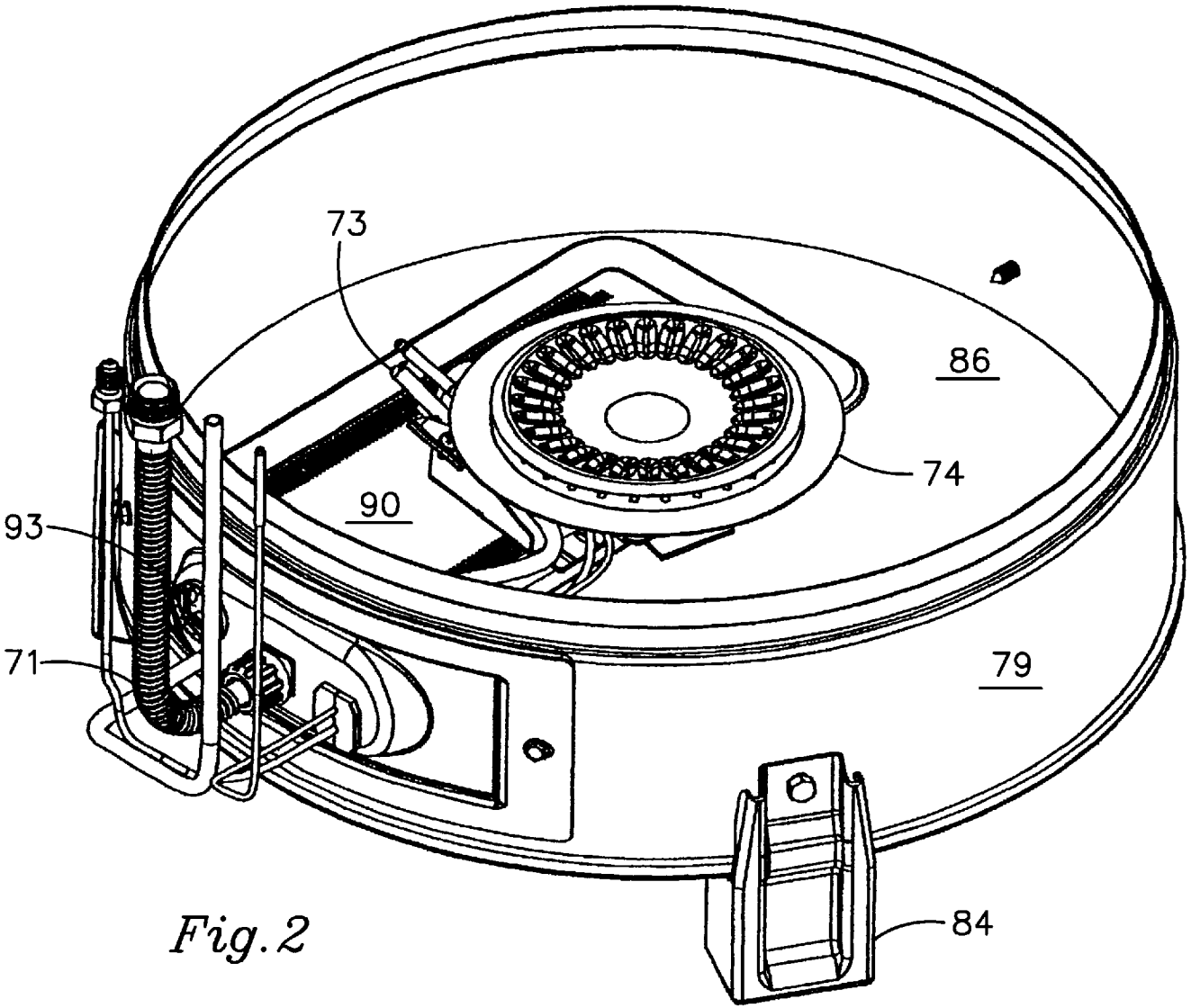
FIG. 2 is a schematic perspective view of the combustion chamber of a water heater of the type shown in FIG. 1.
Figure 4:
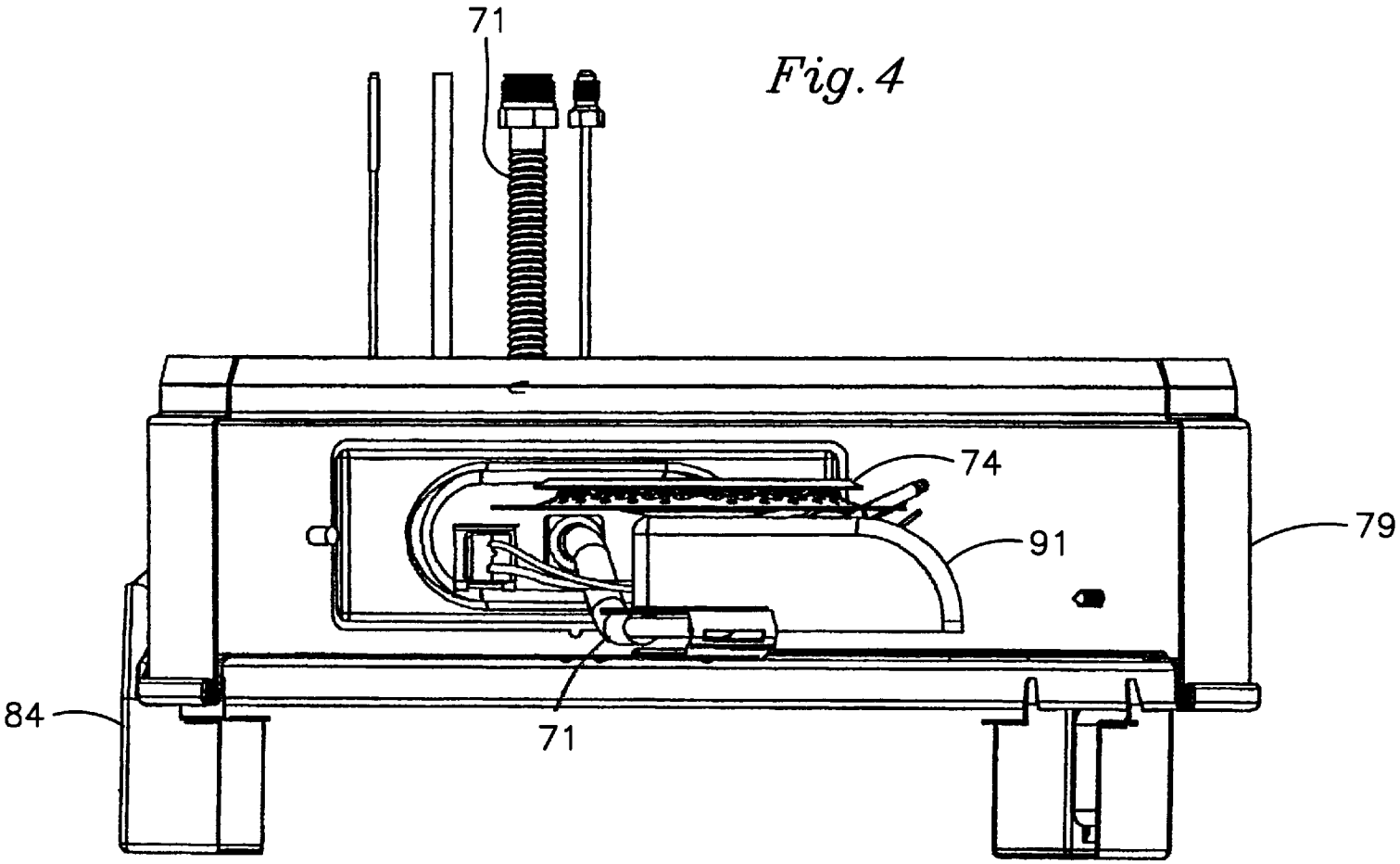
FIG. 4 is a cross-sectional view of the combustion chamber taken through the line A—A in FIG. 3.
Figure 5:
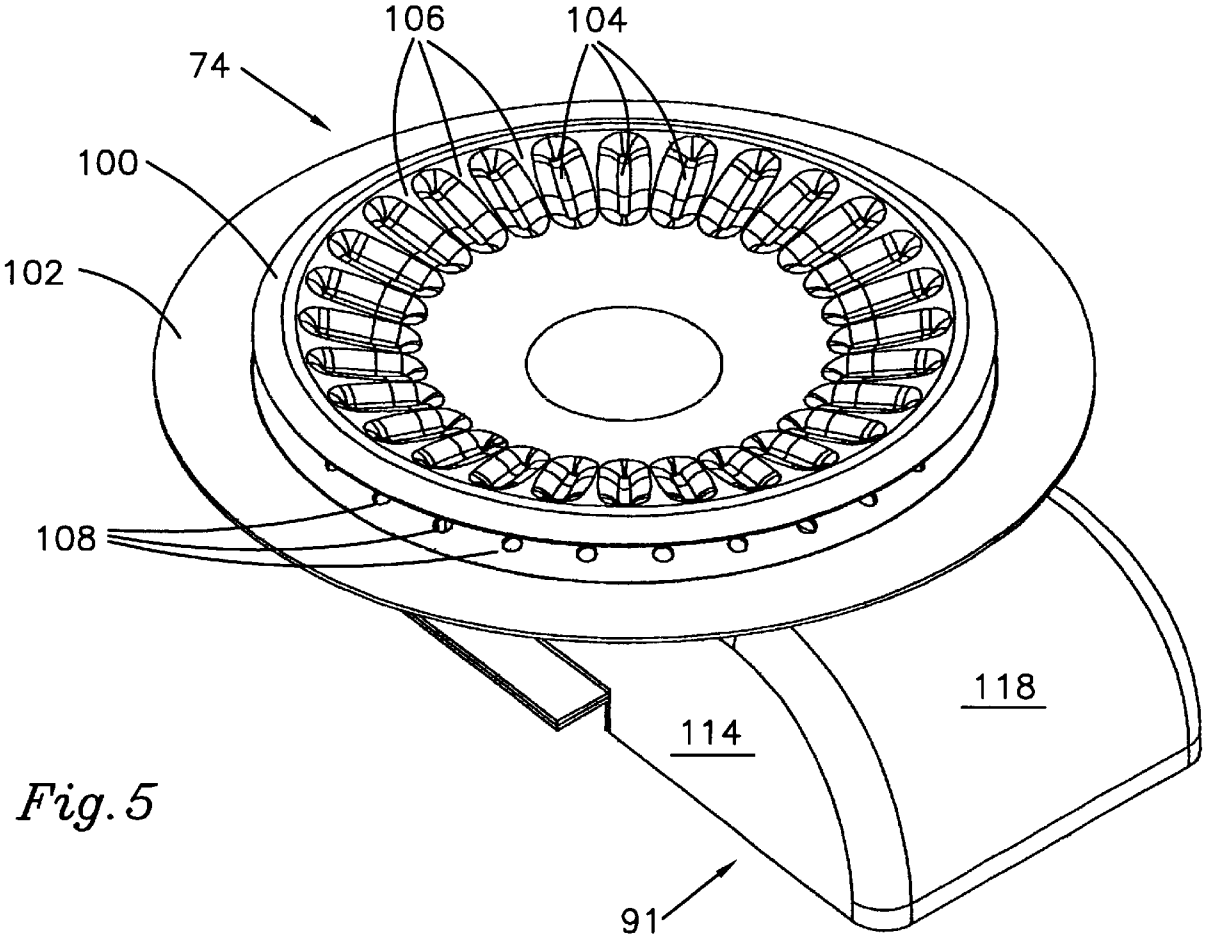
FIG. 5 is a schematic perspective view of a burner and low $NO_x$ hood according to the invention.
Figure 6:
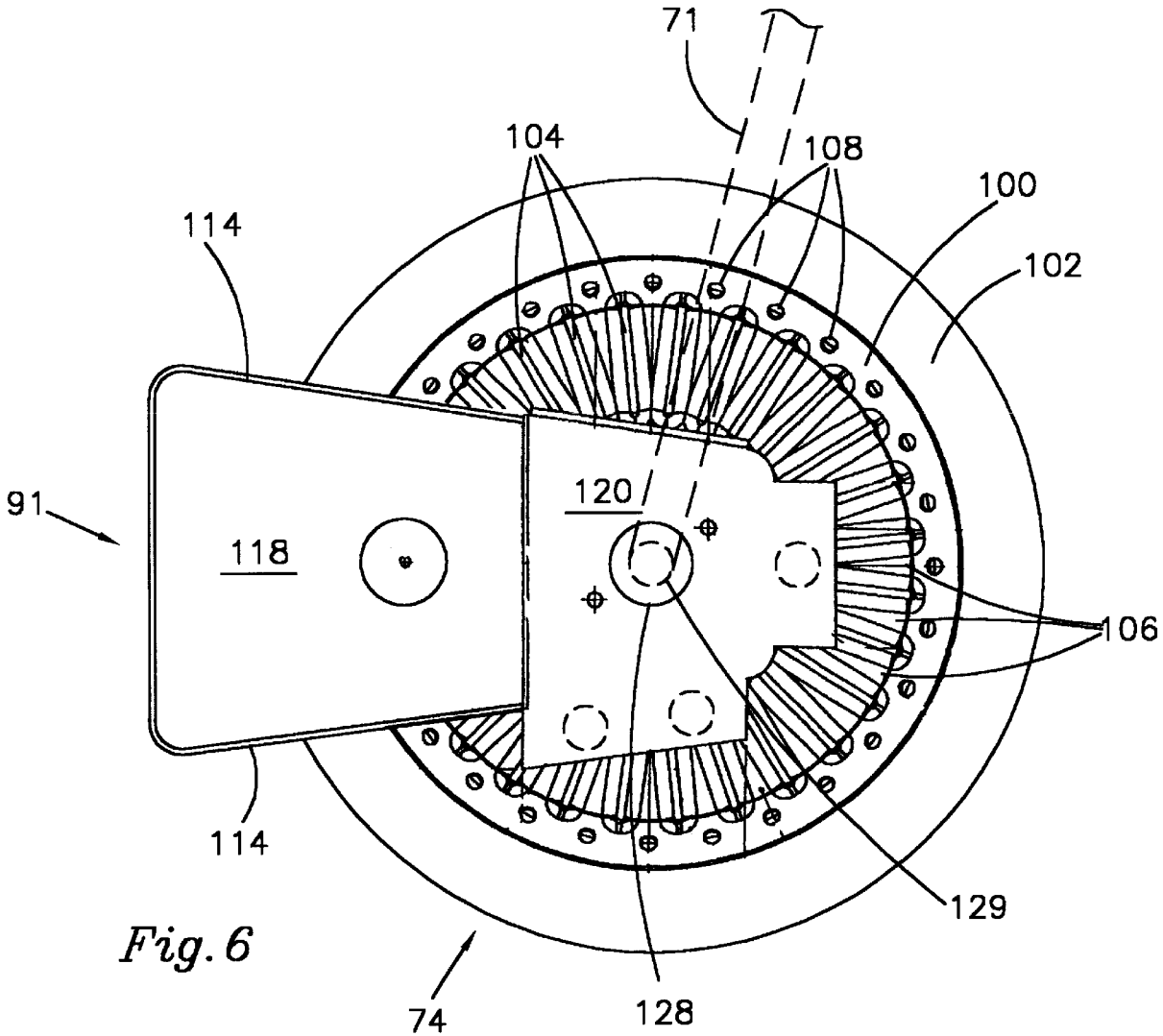
FIG. 6 is an inverted plan view of the burner and low $NO_x$ hood of FIG. 5.
Figure 7:
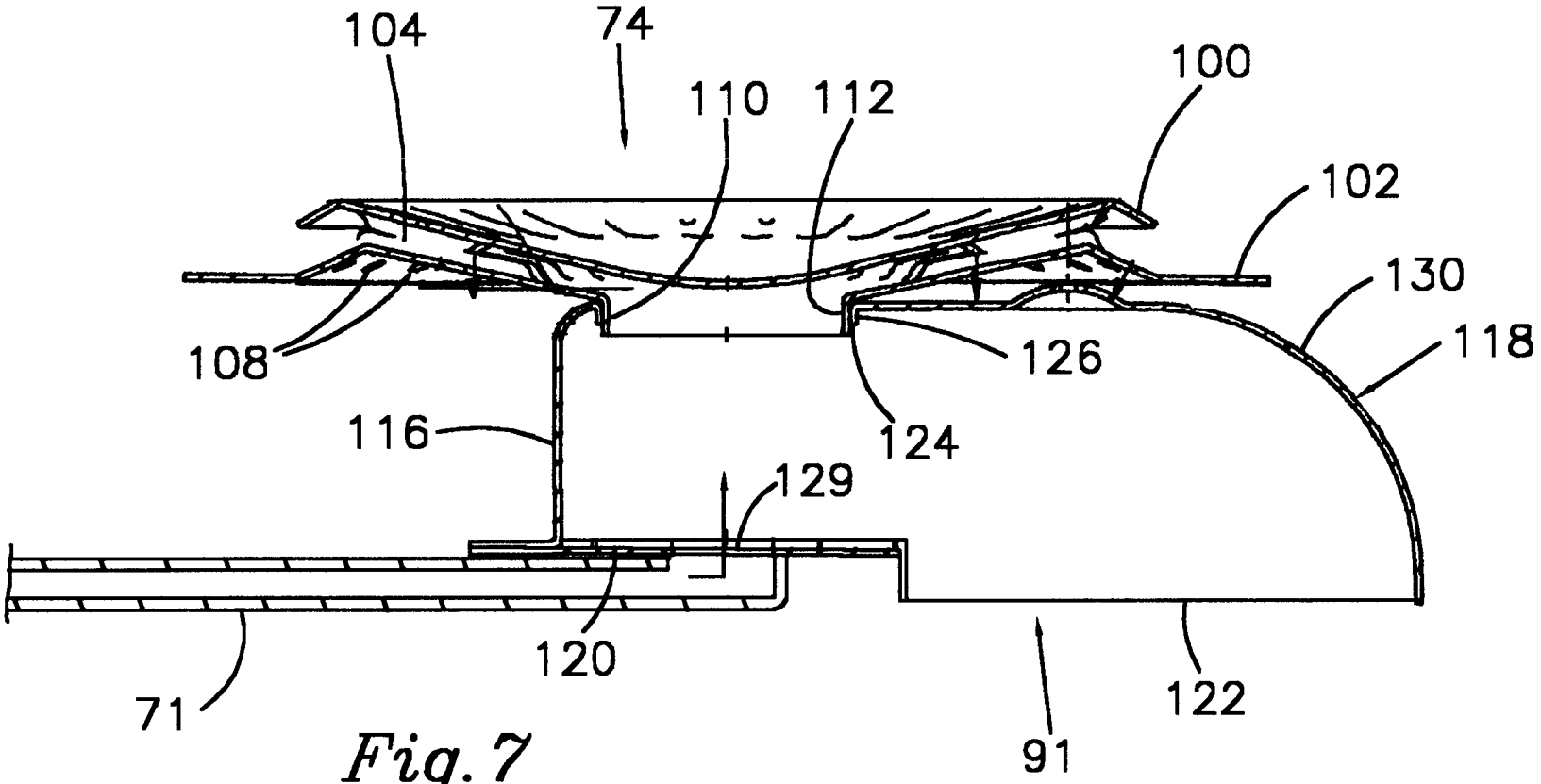
FIG. 7 is a cross-sectional view of the burner and low $NO_x$ hood taken through the line VII—VII of FIG. 6.
Figure 8:
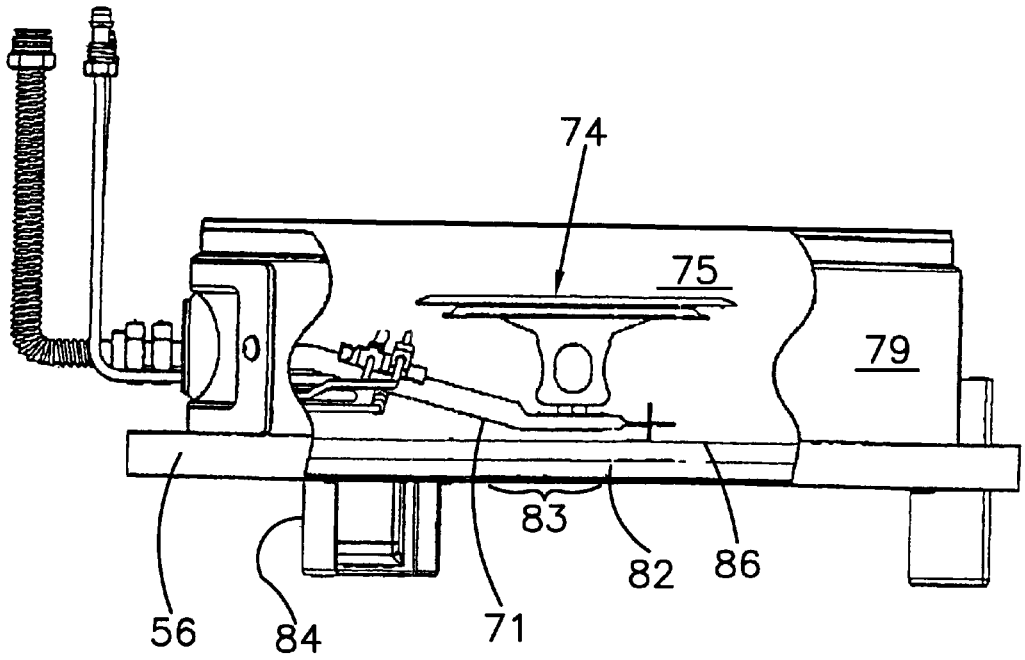
Fig. 8 PRIOR ART
FIG. 8 is an elevation view of a prior art combustion chamber generally similar to that shown in FIG. 4, partially cut-away to show a conventional burner.

With reference to FIG. 8, the lower portion is quite similar to FIGS. 2 and 4 and corresponding reference numerals are used. The burner 74 lacks the extended lower sheet 102 of FIG. 5 and the holes 108 therein. The diverter 91 is absent. The support pan 56 is included although this is also used in the invention but not illustrated, for clarity reasons only. The support pan 56 and base 86 define an air space 82 below the combustion chamber. Combustion air enters the air space 86 upstream of the combustion chamber 75 via the entry hole 83.

It is to be understood that the invention disclosed and defined herein extends to all alternative combinations of the individual features mentioned or evident from the text or drawings. All of these different combinations constitute various alternative aspects of the invention. The foregoing describes embodiments of the present invention and modifications, obvious to those skilled in the art can be made to them, without departing from the scope of the present invention.

What is claimed is:

1. A water heater comprising:

a water container;

a combustion chamber adjacent the container, said combustion chamber having at least one air inlet to admit air and extraneous fumes into said combustion chamber and confine ignition and combustion of said extraneous fumes within said combustion chamber;

a burner associated with said combustion chamber and arranged to combust fuel to heat water in said container; and an air diverter operatively positioned between said air inlet and said burner which channels at least a portion of combustion air passing through at least a portion of said air inlet such that said combustion air and said fuel are mixed in the air diverter prior to entering said burner.

2. A water heater comprising:

a water container;

a combustion chamber adjacent the container, said combustion chamber having at least one air inlet to admit air and extraneous fumes into said combustion chamber and confine ignition and combustion of said extraneous fumes within said combustion chamber;

a burner associated with said combustion chamber and arranged to combust fuel to heat water in said container;

an air diverter operatively positioned between said air inlet and said burner and adapted to channel at least a portion of combustion air passing through at least a portion of said air inlet to a position for mixture with said fuel prior to entering said burner; and a fuel line positioned to introduce said fuel into said diverter.

3. A water heater comprising:

a water container;

a combustion chamber adjacent the container, said combustion chamber having at least one air inlet to admit air and extraneous fumes into said combustion chamber and confine ignition and combustion of said extraneous fumes within said combustion chamber;

a burner associated with said combustion chamber and arranged to combust fuel to heat water in said container;

an air diverter operatively positioned between said air inlet and said burner and adapted to channel at least a portion of combustion air passing through at least a portion of said air inlet to a position for mixture with said fuel prior to entering said burner; and wherein said diverter comprises a draft hood including a pair of substantially vertically oriented side walls, a substantially vertically oriented end wall connected between said side walls, and a cover connected to edge portions of said walls, at least said side walls forming a lower opening to receive said air and said cover having an upper opening oriented to pass premixed fuel and air to an opening in said burner.

4. The water heater defined in claim 3, wherein said cover has a downwardly curved portion extending over said air inlet.

5. The water heater defined in claim 3, wherein said lower opening is positioned over said air inlet.

6. The water heater defined in claim 3, wherein said lower opening is spaced about ¼-inch above said air inlet.

7. The water heater defined in claim 3, wherein said diverter further comprises a lower floor connected between at least a portion of said walls.

8. The water heater defined in claim 7, wherein said lower floor has an opening connected to a fuel line extending into said combustion chamber.

9. The water heater defined in claim 3, wherein said burner has an opening connected to said cover to receive premixed fuel and air from said diverter.

10. A water heater comprising:

a water container;

a combustion chamber adjacent the container, said combustion chamber having at least one air inlet to admit air and extraneous fumes into said combustion chamber and confine ignition and combustion of said extraneous fumes within said combustion chamber;

a burner associated with said combustion chamber and arranged to combust fuel to heat water in said container;

an air diverter operatively positioned between said air inlet and said burner and adapted to channel at least a portion of combustion air passing through at least a portion of said air inlet to a position for mixture with said fuel prior to entering said burner; and wherein said burner comprises two metallic sheets fixed together and wherein an upper sheet thereof has a smaller diameter than a lower sheet thereof.

11. The water heater defined in claim 10, wherein said metallic sheets are shaped to form a multiplicity of radially extending channels through which premixed gas and air flow prior to combustion.

12. The water heater defined in claim 11, wherein the lower sheet has an opening positioned at a distal end portion of substantially all of said channels.

13. A water heater comprising:

a water container;

a combustion chamber adjacent the container, said combustion chamber having at least one air inlet to admit air and extraneous fumes into said combustion chamber and confine ignition and combustion of said extraneous fumes within said combustion chamber;

a burner associated with said combustion chamber and arranged to combust fuel to heat water in said container;

an air diverter operatively positioned between said air inlet and said burner and adapted to channel at least a portion of combustion air passing through at least a portion of said air inlet to a position for mixture with said fuel prior to entering said burner; and wherein said diverter extends across one side of said air inlet, but not across a corresponding opposed side of said air inlet.

14. The water heater defined in claim 3, wherein said side walls taper towards one another in the direction of said end wall.

15. A water heater comprising:

a water container;

a combustion chamber adjacent the container, said combustion chamber having at least one air inlet to admit air and extraneous fumes into said combustion chamber and confine ignition and combustion of said extraneous fumes within said combustion chamber;

a burner associated with said combustion chamber and arranged to combust fuel to heat water in said container; and an air diverter connected to said burner and a fuel line and positioned to receive at least a portion of combustion air passing through at least a portion of said air inlet and having an opening to said burner through which mixed fuel and combustion air pass for combustion at said burner.

* * * * *